US008979480B2

(12) United States Patent
Inomata et al.

(10) Patent No.: US 8,979,480 B2
(45) Date of Patent: Mar. 17, 2015

(54) STEAM TURBINE

(75) Inventors: Asako Inomata, Kanagawa-ken (JP); Katsuya Yamashita, Tokyo (JP); Kazuhiro Saito, Kanagawa-ken (JP); Takao Inukai, Kanagawa-ken (JP); Kazutaka Ikeda, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 604 days.

(21) Appl. No.: 13/144,795

(22) PCT Filed: Jan. 15, 2010

(86) PCT No.: PCT/JP2010/050381

§ 371 (c)(1),
(2), (4) Date: Jul. 15, 2011

(87) PCT Pub. No.: WO2010/082615

PCT Pub. Date: Jul. 22, 2010

(65) Prior Publication Data

US 2011/0274536 A1 Nov. 10, 2011

(30) Foreign Application Priority Data

Jan. 16, 2009 (JP) ..... 2009-007711

(51) Int. Cl.
*F04D 29/58* (2006.01)
*F01D 5/08* (2006.01)
(Continued)

(52) U.S. Cl.
CPC ..... *F01D 5/082* (2013.01); *F01D 5/085* (2013.01); *F01D 11/001* (2013.01); *F01D 11/02* (2013.01); *F01D 11/04* (2013.01); *F05D 2240/55* (2013.01); *F05D 2240/81* (2013.01)
USPC ..... 415/115; 415/113; 415/174.5

(58) Field of Classification Search
USPC ..... 415/170.1, 173.7, 174.5, 146, 147, 415/168.1, 168.2, 168.4, 175, 180, 183, 415/185, 191; 416/90 R, 91, 95, 96 R, 97 R
See application file for complete search history.

(56) References Cited

U.S. PATENT DOCUMENTS 3,291,447 A 12/1966 Brandon
4,021,138 A 5/1977 Scalzo et al.
(Continued)

FOREIGN PATENT DOCUMENTS

CN 1417462 A 5/2003
CN 101135247 A 3/2008
(Continued)

OTHER PUBLICATIONS

Translation of International Preliminary Report on Patentability of PCT/JP2010/050381, dated Aug. 16, 2011, 5 pages.

*Primary Examiner* — Dwayne J White
*Assistant Examiner* — Justin Seabe
(74) *Attorney, Agent, or Firm* — Foley & Lardner LLP

(57) ABSTRACT

A plurality of blades are studded in a rotor disc integrated with the rotor along the circumferential direction of the rotor, a plurality of vanes are attached to a casing covering the rotor along the circumferential direction of the rotor, and an internal diaphragm disposed on rotor-side surfaces of the vanes in such a way that the internal diaphragm faces the rotor disc. The vanes and the blades adjacent to each other in the axial direction of the rotor form a turbine stage. A rotor-side cooling path is formed through the rotor disc in the axial direction of the rotor, and a diaphragm-side cooling path is formed through the internal diaphragm in the axial direction of the rotor, and a cooling medium flowing through the rotor-side cooling path diverts into the diaphragm-side cooling path and a labyrinth flow path provided between the internal diaphragm and the rotor.

9 Claims, 8 Drawing Sheets

(51) Int. Cl.

| | |
|---|---|
| ***F01D 11/00*** | (2006.01) |
| ***F01D 11/02*** | (2006.01) |
| ***F01D 11/04*** | (2006.01) |

(56) References Cited

U.S. PATENT DOCUMENTS

| | | | |
|---|---|---|---|
| 4,730,982 | A | 3/1988 | Kervistin |
| 6,506,021 | B1 | 1/2003 | Wilson et al. |
| 2005/0163612 | A1 | 7/2005 | Reigl |
| 2008/0056895 | A1 | 3/2008 | Senoo |

FOREIGN PATENT DOCUMENTS

| | | | | |
|---|---|---|---|---|
| JP | 51-143067 | A | | 11/1976 |
| JP | 53-061502 | U | | 5/1978 |
| JP | 57-188702 | A | | 11/1982 |
| JP | 59068501 | A | * | 4/1984 |
| JP | 59-126003 | A | | 7/1984 |
| JP | 60-035103 | A | | 2/1985 |
| JP | 61-250304 | A | | 11/1986 |
| JP | 62-182404 | A | | 8/1987 |
| JP | 63-205403 | A | | 8/1988 |
| JP | 07-145707 | A | | 6/1995 |
| JP | 10-131702 | A | | 5/1998 |
| JP | 11-200801 | A | | 7/1999 |
| JP | 2005-538284 | A | | 12/2005 |
| JP | 2006-104951 | A | | 4/2006 |
| JP | 2008-057416 | A | | 3/2008 |
| RU | 2 279 551 | C1 | | 7/2006 |

* cited by examiner

STEAM TURBINE

TECHNICAL FIELD

The present invention relates to a steam turbine, and particularly, to a steam turbine using high-temperature steam having a temperature ranging from approximately 650 to 750° C.

BACKGROUND ART

A steam turbine using primary steam having a temperature of approximately 600° C. is in practical use from the viewpoint of improvement in turbine efficiency. To further improve the turbine efficiency, studies on increasing the temperature of the primary steam to a value ranging from approximately 650 to 750° C. have been conducted and developments according to the studies have been performed.

In such a steam turbine, since the primary steam is of high temperature, it is necessary to use a heat-resistant alloy as in the case of a gas turbine. However, no heat-resistant alloy can be used, for example, because such a heat-resistant alloy is expensive and makes it difficult to manufacture a large component. In such case, the strength of the material of the turbine is insufficient and it is necessary to cool the components of the turbine.

Japanese Patent Laid-Open Publication No. 11-200801 (Patent Document 1) discloses a cooling mechanism used with rotor discs integrated with a rotor and studded with blades. The cooling mechanism cools the vicinity of blade studded portions of the rotor discs, in particular, rotor discs in the second state and the following stages. In the cooling mechanism, a cooling fluid is directly supplied into cooling spaces formed by side surfaces of the rotor discs and internal side surfaces of vanes through cooling path holes formed in the rotor.

However, it is not easy to readily form the cooling path holes, which are provided to cool the vicinity of the blade studded portions of the rotor discs as described in Patent Document 1, in the rotor inside the rotor discs, and it is also not always preferred to form the cooling path holes from the viewpoint of ensuring the strength of the rotor.

Further, in turbine stages that require cooling, such as the rotor discs, the cooling steam that contributed to the cooling in the upstream side turbine stages and then cools the cooling steam increased in temperature in the downstream side turbine stages, which may cause a case of insufficient cooling.

DISCLOSURE OF THE INVENTION

The present invention has been made in view of the circumstances described above, and an object of the present invention is to provide a steam turbine including a cooling structure capable of ensuring strength of a rotor, rotor discs, and other components of the turbine to maintain integrity thereof even when high-temperature steam is used.

Another object of the present invention is to provide a steam turbine in which turbine components in downstream side turbine stages disposed in a range in which cooling is required can be effectively cooled.

A steam turbine of the present invention provided for achieving the above objects includes:

a rotor;

a rotor disc integrated with the rotor;

a plurality of blades with which the rotor disc is studded along a circumferential direction of the rotor;

a casing that covers the rotor;

a plurality of vanes attached to the casing along the circumferential direction of the rotor in positions adjacent to the blades and on an upstream side in an axial direction of the rotor; and an internal diaphragm disposed on rotor-side surfaces of the vanes in the axial direction of the rotor in such a way that the internal diaphragm faces the rotor disc, wherein the vanes and the blades adjacent to each other in the axial direction of the rotor form a turbine stage, in at least one of the turbine stages, a rotor-side cooling path is formed through the rotor disc in the axial direction of the rotor and a diaphragm-side cooling path is formed through the internal diaphragm in the axial direction of the rotor, and a cooling medium flowing through the rotor-side cooling path diverts into the diaphragm-side cooling path and a labyrinth flow path provided between the internal diaphragm and the rotor.

In the steam turbine described above, a plurality of turbine stages, each of which has the diaphragm-side cooling path which passes through the internal diaphragm in the axial direction of the rotor and through which the cooling medium flows, are formed, and among the plurality of turbine stages, each of which has the diaphragm-side cooling paths formed therein, the diaphragm-side cooling path is formed in parallel to the axis of the rotor in upstream-side turbine stages, and an outlet of the diaphragm-side cooling path is positioned closer to the rotor than an inlet of the diaphragm-side cooling path in downstream-side turbine stages.

According to the present invention, since the cooling medium can cool the rotor, the rotor discs, the internal diaphragms, and other components in a wide range of turbine stages from an upstream side to a downstream side, the strength of each of the turbine components, such as the rotor, can be ensured, and hence, the integrity of each of the turbine components can be maintained even when high-temperature steam is used.

MODES FOR CARRYING OUT THE INVENTION

The best mode for carrying out the present invention will be described below with reference to the drawings. However, it is to be noted that the present invention is not limited to the following embodiments. Further, in the following description, it should be understood that the terms "upper", "lower", "right", "left", and other terms concerning direction are used herein only in the context of illustration or actual installation.

Figure 1:
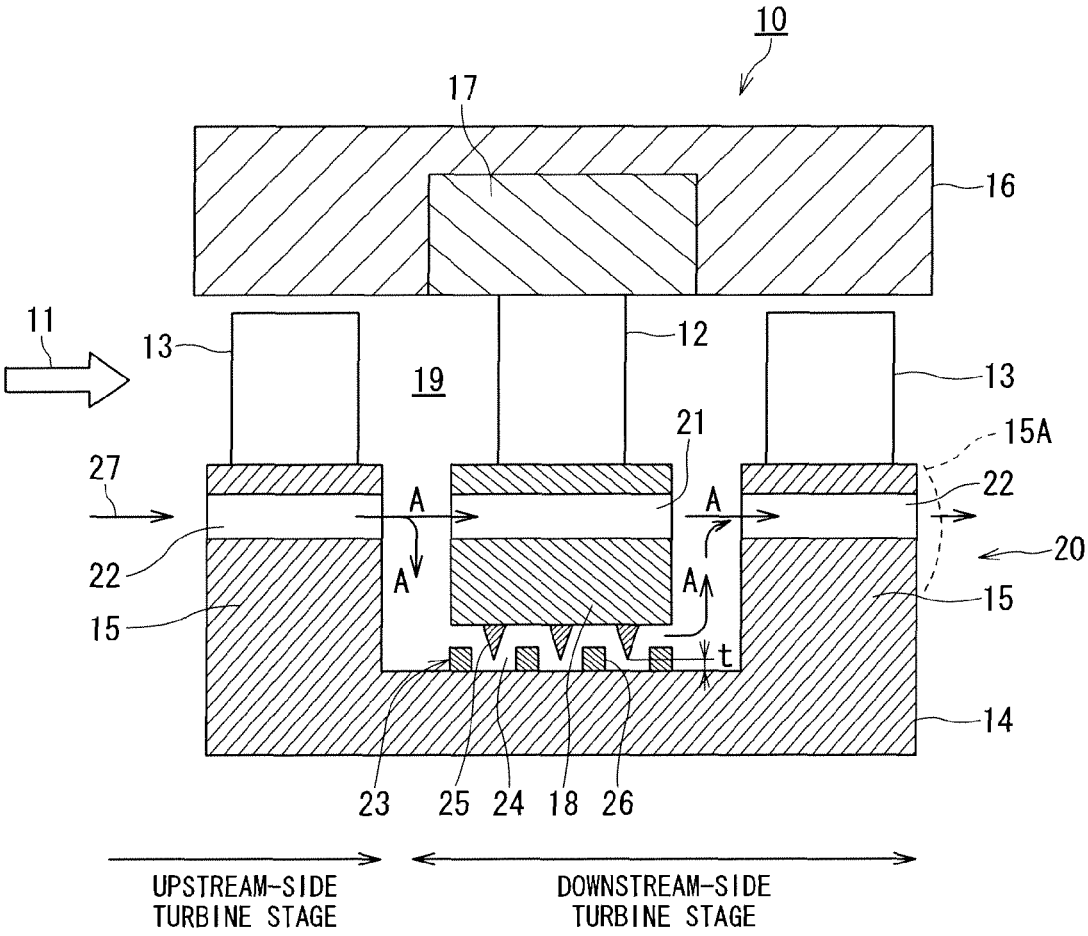
FIG. 1 is a partial cross-sectional view showing a part of a steam turbine according to a first embodiment of the present invention.

[A] First Embodiment (FIG. 1)

FIG. 1 is a partial cross-sectional view showing a part of a steam turbine according to a first embodiment of the present invention. In a steam turbine 10 shown in FIG. 1, high-temperature primary steam 11 having a temperature ranging from approximately 650 to 750° C. is guided via vanes (stationary blades) 12 to blades (moving blades) 13 to rotate a rotor 14 to which the blades 13 are studded so that a generator, not shown, connected to the rotor 14 is rotated. The use of such high-temperature primary steam 11 can improve turbine efficiency.

A plurality of blades 13 are studded to the outer peripheral portion of each rotor disc 15, which is integrated to the rotor 14, along the circumferential direction of the rotor 14.

The rotor 14 is covered with a casing 16, to which the a plurality of vanes 12 are attached via an external diaphragm 17 along the circumferential direction of the rotor 14 in positions adjacent to the blades 13 and on the upstream side in the axial direction of the rotor 14. An internal diaphragm 18 is disposed on the vanes 12 in the axial direction of the rotor 14 in such a way that the internal diaphragm 18 faces the rotor discs 15 of the rotor 14. The plural vanes 12, supported by the external diaphragm 17 and the internal diaphragm 18, guide the primary steam 11 to the blades 13.

The vanes 12 and the blades 13 are alternately arranged in the axial direction of the rotor 14, and a set of adjacent vanes 12 and blades 13 forms a turbine stage. The turbine stages are numbered as follows: a first stage, a second stage, a third stage, and so on in the direction in which the primary steam 11 flows from the upstream side to the downstream side. A space in which the vanes 12 and the blades 13 are alternately arranged in the axial direction of the rotor 14 forms a steam path 19 through which the primary steam 11 flows.

In the thus configured steam turbine 10, a cooling structure 20 is provided in at least one of the turbine stages to cool the components of the turbine, particularly, the rotor 14 and the rotor disc 15 and internal diaphragm 18, to ensure the strength of each of the components. The cooling structure 20 in the steam turbine includes a diaphragm-side cooling path 21 and a rotor-side cooling path 22.

The rotor-side cooling path 22 is formed in a rotor disc 15, which is integrated with the rotor 14, in the vicinity of a portion 15A studded with a blade 13. The rotor-side cooling path 22 extends linearly in parallel to the axis of the rotor 14 through the rotor disc 15 in the axial direction of the rotor 14. The rotor-side cooling path 22 is actually formed of a plurality of rotor-side cooling paths arranged at predetermined intervals in the circumferential direction of the rotor 14. On the other hand, the diaphragm-side cooling path 21 is formed so as to extend linearly in parallel to the axis of the rotor 14 through the internal diaphragm 18 in the axial direction of the rotor 14. The diaphragm-side cooling path 21 is actually formed of a plurality of diaphragm-side cooling paths arranged at predetermined intervals in the circumferential direction of the rotor 14.

A labyrinth section 23, which forms a labyrinth flow path 24, is provided between the internal diaphragm 18 and the rotor 14. The labyrinth section 23 includes labyrinth teeth 25 protruding from the internal diaphragm 18 and labyrinth pieces 26 protruding from the rotor 14 in a manner that the labyrinth teeth 25 and the labyrinth pieces 26 are alternately arranged along the axial direction of the rotor 14. The labyrinth section 23 basically seals the gap between the internal diaphragm 18 and the rotor 14 to prevent the primary steam 11 flowing through the steam path 19 from leaking through the gap. The labyrinth flow path 24 is formed by the inner circumferential surface of the internal diaphragm 18 and the outer circumferential surface of the rotor 14 and partitioned by the labyrinth teeth 25 and the labyrinth pieces 26.

A cooling medium 27, such as cooling steam having a temperature lower than that of the primary steam 11, flows through the rotor-side cooling paths 22, the diaphragm-side cooling paths 21, and the labyrinth flow path 24. That is, the cooling medium 27 introduced into the rotor-side cooling paths 22 in an upstream rotor disc 15 and passing through the rotor-side cooling paths 22 diverts into the diaphragm-side cooling paths 21 in the downstream internal diaphragm 18 and the labyrinth flow path 24. The diverted flows of the cooling medium 27 then merge, and the merged cooling medium 27 flows through the rotor-side cooling paths 22 in the same downstream rotor disc 15, as indicated by the arrows A.

The provision of the diaphragm-side cooling paths 21 prevents or substantially prevents the cooling medium 27 having flowed through the rotor-side cooling paths 22 in the upstream rotor disc 15 from flowing into the steam path 19 but allows the cooling medium 27 to flow toward the downstream stage. When the cooling medium 27 having flowed out of the rotor-side cooling paths 22 in the upstream rotor disc 15 flows through the labyrinth flow path 24, and the cooling medium 27 having flowed through the labyrinth flow path 24 flows into the rotor-side cooling paths 22 in the downstream rotor disc 15, the upstream and downstream rotor discs 15 and the internal diaphragm 18 (the rotor discs 15, in particular) are cooled.

As mentioned above, the proportions of the cooling medium 27 having flowed out of the rotor-side cooling paths 22 and diverting into the diaphragm-side cooling paths 21 and the labyrinth flow path 24 are determined based on pressure loss in the diaphragm-side cooling paths 21 and pressure loss in the labyrinth flow path 24, that is, by controlling the pressure loss in the diaphragm-side cooling paths 21 and the pressure loss in the labyrinth flow path 24. The pressure loss in the diaphragm-side cooling paths 21 depends on the number of diaphragm-side cooling paths 21 formed in the internal diaphragm 18, the cross-sectional area of each of the diaphragm-side cooling paths 21, and other factors. The pressure loss in the labyrinth flow path 24 depends on the number of labyrinth teeth 25, the dimension "t" from the labyrinth teeth 25 to the outer circumferential surface of the rotor 14, and other factors.

The present embodiment therefore provides the following advantageous effects (1) and (2).

(1) The cooling medium 27 having flowed through the rotor-side cooling paths 22 in an upstream-side rotor disc 15 diverts into the diaphragm-side cooling paths 21 in the downstream-side internal diaphragm 18 and the labyrinth flow path 24 provided between the internal diaphragm 18 and the rotor 14, and the cooling medium 27 is therefore not allowed to flow into the steam path 19, through which the primary steam 11 flows, or the flow rate of the cooling medium 27 flowing into the steam path 19 can be reduced, and the cooling medium 27 can instead be guided through the diaphragm-side cooling paths 21 into the rotor-side cooling path 22 in the downstream-side rotor disc 15. As a result, the cooling medium 27 can cool the rotor discs 15 integrated with the rotor 14, the internal diaphragms 18, and other components in a wide range of turbine stages from the upstream-side to the downstream-side, and accordingly, the strength of each of the components of the turbine (rotor 14 and the rotor discs 15, in particular) can be ensured, and hence, the integrity of each of the turbine components can be maintained even when the primary steam 11 used in the turbine has a high temperature ranging from approximately 650 to 750° C.

(2) Since the cooling medium 27 flows through the rotor-side cooling paths 22 formed in the rotor discs 15 integrated with the rotor 14 and the diaphragm-side cooling paths 21 formed in the internal diaphragms 18 that support the vanes 12, the cooling paths can be more readily manufactured than in a case of being formed in the rotor 14, and the strength of the rotor 14 will not decrease.

Figure 2:
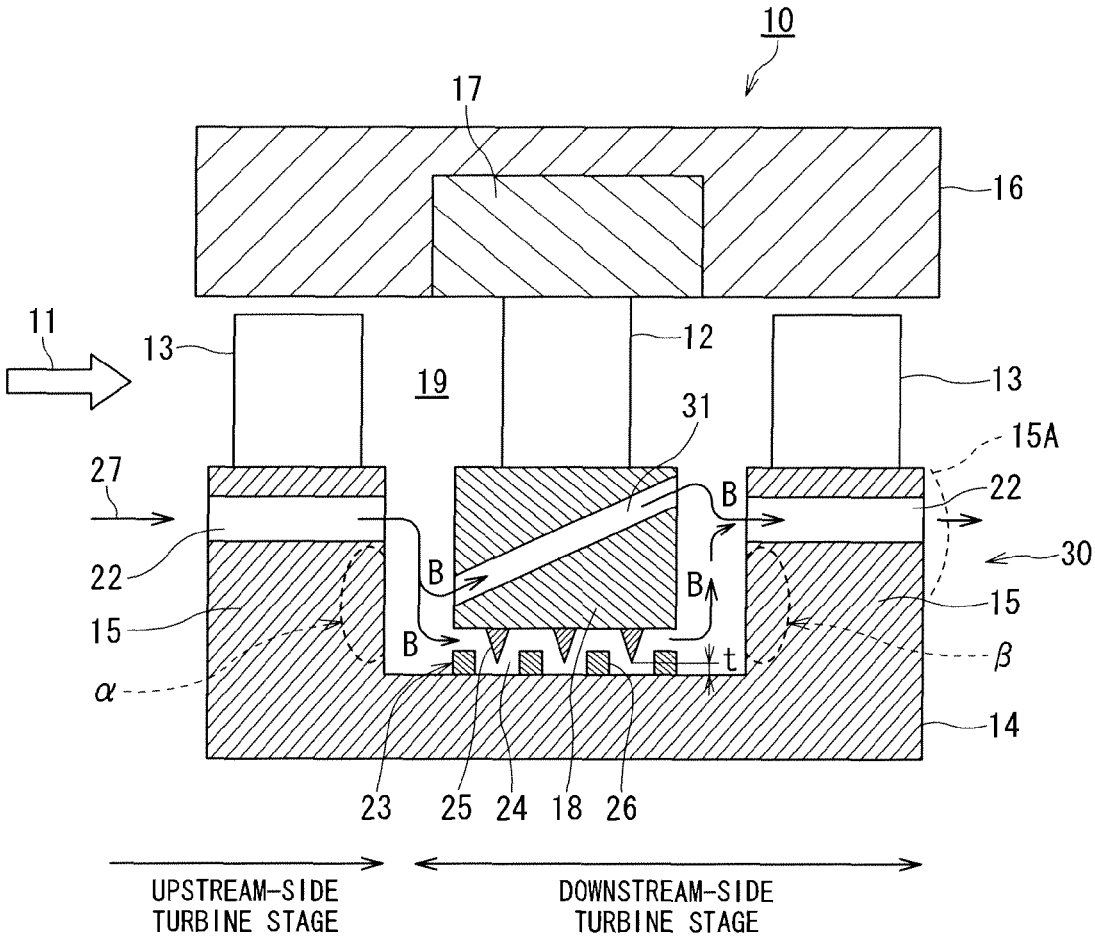
FIG. 2 is a partial cross-sectional view showing a part of a steam turbine according to a second embodiment of the present invention.

[B] Second Embodiment (FIG. 2 and FIG. 3)

FIG. 2 is a partial cross-sectional view showing a part of a steam turbine according to a second embodiment of the present invention. FIG. 3 shows variations of the diaphragm-side cooling paths in each internal diaphragm shown in FIG. 2, in which FIGS. 3(A) to 3(F) are cross-sectional views showing first to sixth variations. In the second embodiment, like reference numerals are added to portions or members corresponding or similar to those in the first embodiment described above, and descriptions thereof portions will be simplified or omitted herein.

A steam turbine cooling structure 30 according to the second embodiment differs from that in the first embodiment in terms of the shape of a diaphragm-side cooling path 31 formed in each internal diaphragm 18. The shape of the diaphragm-side cooling path 31 is determined by a portion that particularly requires cooling, pressure loss in the labyrinth flow path 24, and other factors.

That is, the diaphragm-side cooling path 31 is formed in the internal diaphragm 18 so as to be inclined to the axis of the rotor 14 from the side at which the rotor 14 is present toward the vanes 12 and extends linearly through the internal diaphragm 18 substantially in the axial direction of the rotor 14. The diaphragm-side cooling path 31 is actually formed of a plurality of diaphragm-side cooling paths arranged at predetermined intervals in the circumferential direction of the rotor 14. The cooling medium 27 having flowed out of the rotor-side cooling paths 22 in an upstream-side rotor disc 15 diverts in positions closer to the rotor 14 than in the first embodiment into the diaphragm-side cooling paths 31 in the downstream-side internal diaphragm 18 and the labyrinth flow path 24 between the internal diaphragm 18 and the rotor 14. The diverted flows of the cooling medium 27 flow through the diaphragm-side cooling paths 31 and the labyrinth flow path 24 and then merge, and the merged cooling medium 27 flows through the rotor-side cooling paths 22 in the same downstream-side rotor disc 15, as indicated by arrows B.

According to the structure or configuration described above, since the cooling medium 27 having flowed out of the rotor-side cooling paths 22 in the upstream rotor disc 15 diverts in positions close to the rotor 14, a downstream-side areas α of the upstream-side rotor disc 15 will be particularly cooled.

Figure 3A:
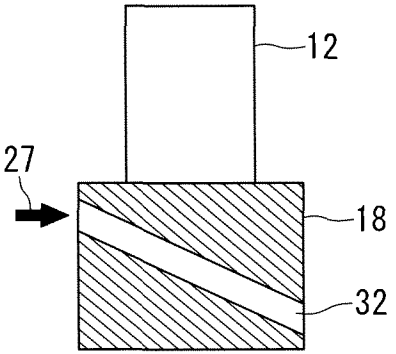
FIG. 3 shows variations of a diaphragm-side cooling path in an internal diaphragm shown in FIG. 2, and FIGS. 3(A) to 3(F) are cross-sectional views showing first to sixth variations.

A diaphragm-side cooling path 32 according to the first variation shown in FIG. 3(A) is formed in each internal diaphragm 18 so as to be inclined to the axis of the rotor 14 from the side at which the vanes 12 are present toward the rotor 14 (see FIG. 2) and extends linearly through the internal diaphragm 18 substantially in the axial direction of the rotor 14. The diaphragm-side cooling path 32 is actually formed of a plurality of diaphragm-side cooling paths arranged at predetermined intervals in the circumferential direction of the rotor 14. The cooling medium 27 having flowed out of the rotor-side cooling paths 22 in an upstream-side rotor disc 15 diverts into the diaphragm-side cooling paths 32 in the downstream-side internal diaphragm 18 and the labyrinth flow path 24 between the internal diaphragm 18 and the rotor 14. The diverted flows of the cooling medium 27 flow out of the diaphragm-side cooling paths 32 and the labyrinth flow path 24 and merge in positions close to the rotor 14, and the merged cooling medium 27 flows into the rotor-side cooling paths 22 in the same downstream-side rotor disc 15.

In this case, since the cooling medium 27 having flowed out of the diaphragm-side cooling paths 32 in the downstream internal diaphragm 18 and the cooling medium 27 having flowed out of the labyrinth flow path 24 merge in positions close to the rotor 14, and the merged cooling medium 27 flows into the rotor-side cooling paths 22 in the same downstream-side rotor disc 15, upstream-side areas β (FIG. 2) of the downstream-stage rotor disc 15 can particularly be cooled.

Figure 3B:
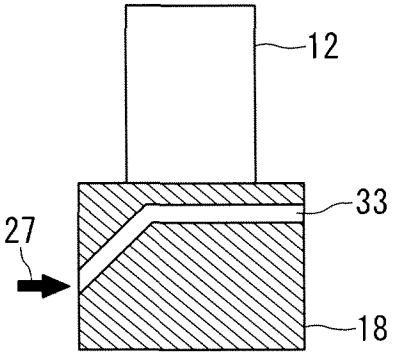

On the other hand, a diaphragm-side cooling path 33 according to the second variation shown in FIG. 3(B) is formed in each internal diaphragm 18 so as to be inclined to the axis of the rotor 14 from the side at which the rotor 14 (see FIG. 2) is present toward the vanes 12, extends linearly to a point somewhere in the middle of the internal diaphragm 18, and further extends in parallel to the axis of the rotor 14 through the internal diaphragm 18 in the axial direction of the rotor 14. The diaphragm-side cooling path 33 is actually formed of a plurality of diaphragm-side cooling paths arranged at predetermined intervals in the circumferential direction of the rotor 14. The cooling medium 27 flows substantially in the same manner as in the case of the diaphragm-side cooling path 31 shown in FIG. 2, and the downstream-side area α (FIG. 2) of the upstream-side rotor disc 15 can particularly be cooled. Further, by guiding the cooling medium 27 flowing through the diaphragm-side cooling paths 33 to positions closer the rotor 14 than in FIG. 2, desired areas of the downstream rotor disc 15 will be suitably cooled and the cooling medium 27 will be prevented from flowing into the steam path 19.

Figure 3C:
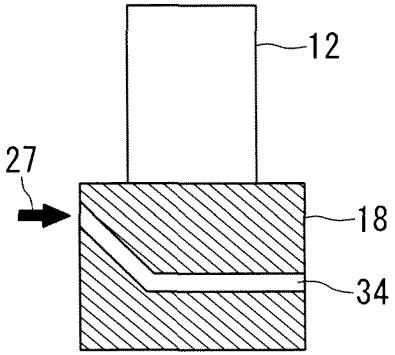

A diaphragm-side cooling path 34 according to the third variation shown in FIG. 3(C) is formed in each internal diaphragm 18 so as to be inclined to the axis of the rotor 14 from the side at which vanes 12 are present toward the rotor 14 (see FIG. 2), extends linearly to a point somewhere in the middle of the internal diaphragm 18, and further extends in parallel to the axis of the rotor 14 through the internal diaphragm 18 in the axial direction of the rotor 14. The diaphragm-side cooling path 34 is actually formed of a plurality of diaphragm-side cooling paths arranged at predetermined intervals in the circumferential direction of the rotor 14. The cooling medium 27 flows substantially in the same manner as in the case of the diaphragm-side cooling path 32 shown in FIG. 3(A), but the positions where the cooling medium 27 having flowed out of the diaphragm-side cooling paths 34 merges with the cooling medium 27 having flowed out of the labyrinth flow path 24 can be set in desired positions closer to the blades 13 than the upstream-side areas β.

Figure 3D:
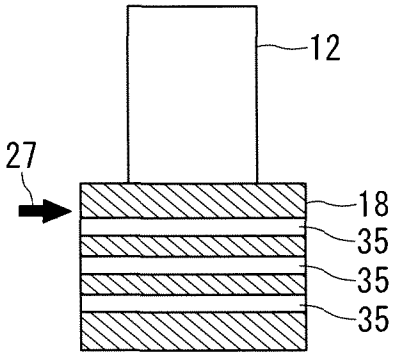
Figure 3E:
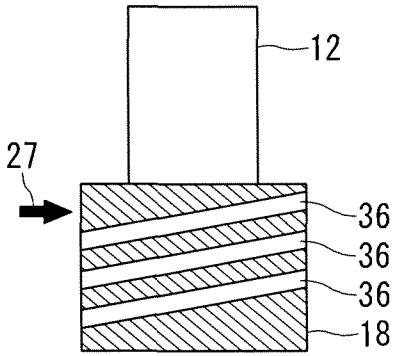
Figure 3F:
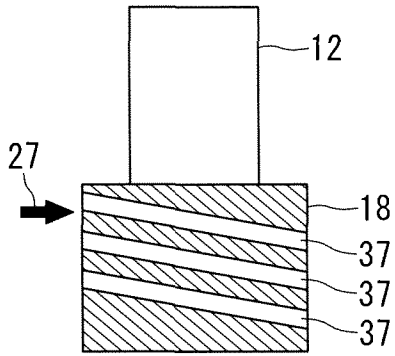

Diaphragm-side cooling paths 35, 36, and 37 represented by the fourth, fifth, and sixth variations respectively shown in FIGS. 3(D), 3(E), and 3(F) are formed in each internal diaphragm 18 and have the same shapes as those of the diaphragm-side cooling path 21 (FIG. 1), the diaphragm-side cooling path 31 (FIG. 2), and the diaphragm-side cooling path 32 (FIG. 3(A)) except that each of the diaphragm-side cooling paths 35, 36 and 37 is actually formed of a plurality of diaphragm-side cooling paths disposed in parallel to the radial direction of the rotor 14 and the cross-sectional area thereof is smaller. Each of the plurality of diaphragm-side cooling paths 35, 36 and 37 is further formed of a plurality of diaphragm-side cooling paths disposed at predetermined intervals in the circumferential direction of the rotor 14.

In the fourth, fifth and sixth variations, each of the plurality of diaphragm-side cooling paths 35, 36 and 37, has a smaller cross-sectional area, resulting in greater pressure loss produces therein. The fourth, fifth and sixth variations are therefore used in a case where the labyrinth flow path 24 between each internal diaphragm 18 and the rotor 14 produces large pressure loss and can divert the cooling medium 27 having flowed out of the rotor-side cooling paths 22 (see FIG. 2) in an upstream-side rotor disc 15 in a satisfactory manner into the diaphragm-side cooling paths 35, 36, or 37 and the labyrinth flow path 24. The fourth, fifth and sixth variations, of course, function in ways similar to those in the first embodiment (FIG. 1), the second embodiment (FIG. 2), and the first variation (FIG. 3(A)), respectively.

The steam turbine cooling structure 30 according to the second embodiment, including the first to sixth variations thereof described above, also achieves or provides advantageous effects similar to the advantageous effects (1) and (2) provided in the first embodiment described hereinbefore.

Figure 4:
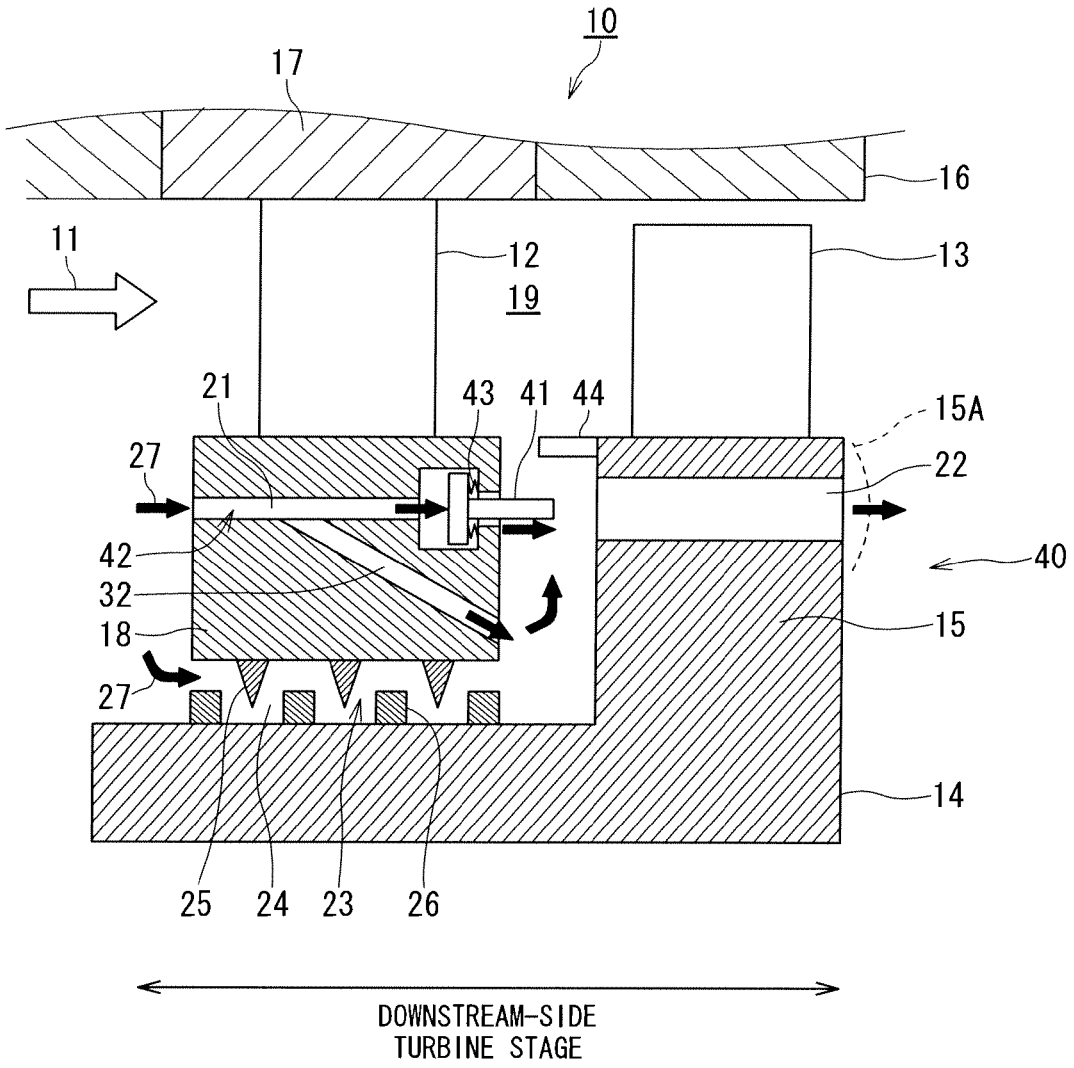
FIG. 4 is a partial cross-sectional view showing a part of a steam turbine according to a third embodiment of the present invention.

[C] Third Embodiment (FIG. 4)

FIG. 4 is a partial cross-sectional view showing a part of a steam turbine according to a third embodiment of the present invention. In the third embodiment, like reference numerals are added to portions or members corresponding or similar to those in the first embodiment, and descriptions of these portions will be simplified or omitted herein.

A steam turbine cooling structure 40 according to the present embodiment differs from the first embodiment described above in that a movable fin 41 that is moved by the cooling medium 27 in the axial direction of the rotor 14 is disposed in each internal diaphragm 18 in this fourth embodiment.

That is, a bifurcated diaphragm-side cooling path 42 is formed in the internal diaphragm 18. The bifurcated diaphragm-side cooling path 42 is a combination of the diaphragm-side cooling path 21 according to the first embodiment (FIG. 1) and the diaphragm-side cooling path 32 according to the first variation of the second embodiment (FIG. 3(A)). The movable fin 41 is arranged on the downstream-side of the diaphragm-side cooling path 42 to a portion thereof corresponding to the diaphragm-side cooling path 21 with the movable fin 41 urged by a spring 43 or any other suitable urging member.

The movable fin 41 is provided so as not to overlap with a fixed fin 44 provided on the adjacent rotor disc 15 when the movable fin 41 substantially retracts in the internal diaphragm 18 due to the urging force produced by the spring 43. According to this configuration, the movable fin 41 is prevented from interfering with the fixed fin 44 when the vanes 12, the external diaphragm 17 and the internal diaphragm 18 are assembled to the casing 16.

When the cooling medium 27 is introduced into the rotor-side cooling paths 22 (see FIG. 1) in an upstream-side rotor disc 15, the cooling medium 27 having flowed out of the rotor-side cooling paths 22 diverts into the diaphragm-side cooling path 42 in the downstream-side internal diaphragm 18 and the labyrinth flow path 24. The diverted flows of the cooling medium 27 flow out of the portion of the diaphragm-side cooling path 42 that corresponds to the diaphragm-side cooling path 32 and the labyrinth flow path 24 and merge, and the merged cooling medium 27 flows into the rotor-side cooling path 22 in the same downstream-side rotor disc 15. In this process, the upstream-side and downstream-side rotor discs 15 (the downstream-side rotor disc 15 in particular) are cooled.

At this moment, the cooling medium 27 having flowed into the portion of the diaphragm-side cooling path 42 that corresponds to the diaphragm-side cooling path 21 presses the movable fin 41 in the axial direction of the rotor 14 against the urging force produced by the spring 43. The movable fin 41 then protrudes toward the adjacent rotor disc 15 and overlaps with the fixed fin 44 thereon as shown in FIG. 4 to thereby narrow the gap between the movable fin 41 and the fixed fin 44.

The thus configured present embodiment provides not only provides advantageous effects similar to the advantageous effects (1) and (2) attained by the first embodiment described above, but also the following advantageous effect (3).

(3) Since each internal diaphragm 18 has the movable fin 41 disposed therein, which can be moved by the cooling medium 27 in the axial direction of the rotor 14 to narrow the gap between the movable fin 41 and the fixed fin 44 on the adjacent rotor disc 15, the cooling medium 27 will not flow into the steam path 19 and the primary steam 11 in the steam path 19 will not flow into the space between the rotor disc 15 and the internal diaphragm 18 where the cooling medium 27 flows.

Figure 5:
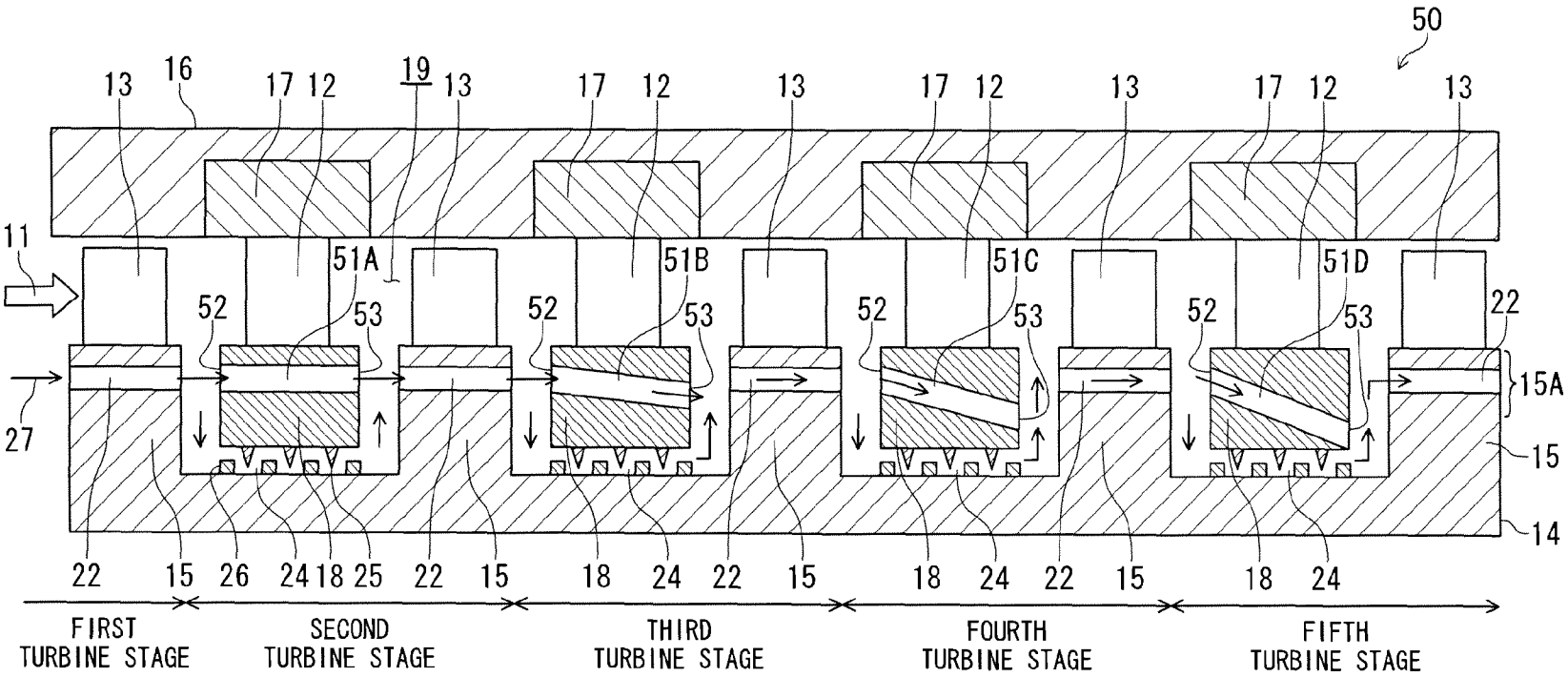
FIG. 5 is a partial cross-sectional view showing a part of a steam turbine according to a fourth embodiment of the present invention.
Figure 6:
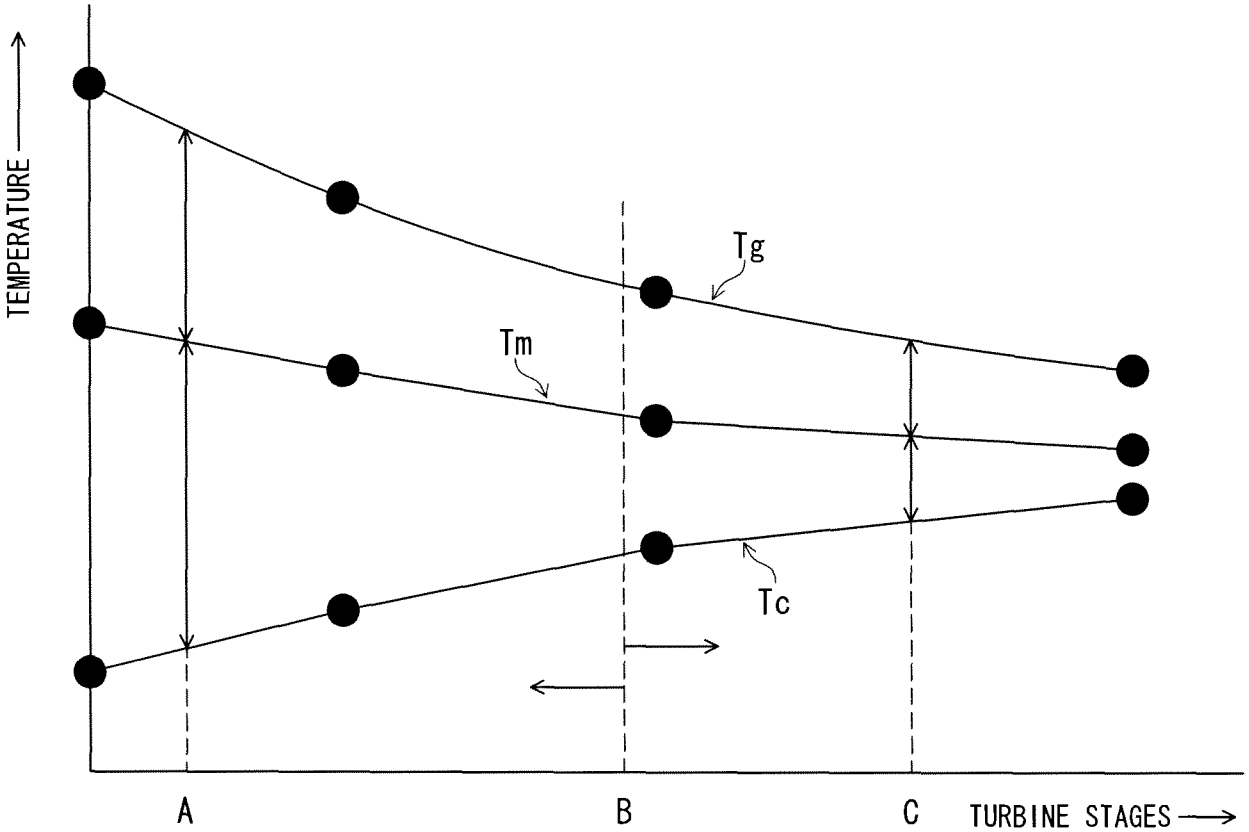
FIG. 6 shows graphs representing a relationship among the temperature of a cooling medium (cooling steam), the temperature of primary steam, and a target temperature of blade studded portions of a rotor disc.

[D] Fourth Embodiment (FIGS. 5 and 6)

FIG. 5 is a partial cross-sectional view showing a part of a steam turbine according to a fourth embodiment of the present invention. In the fourth embodiment, like reference numerals are added to portions or members corresponding or similar to those in the first embodiment, and descriptions of these portions will be simplified or omitted herein.

A steam turbine cooling structure 50 according to the present embodiment differs from those in the first to third embodiments in that among a plurality of turbine stages disposed along the axial direction of the rotor 14, a cooling-requiring turbine stage range where the rotor 14, rotor discs 15, internal diaphragms 18, and other turbine components require cooling (for example, the cooling-requiring range including the first to sixth turbine stages) have diaphragm-side cooling paths 51A, 51B, 51C, 51D, and so on formed in the internal diaphragms 18 and that the shapes of the diaphragm-side cooling paths 51A to 51D and so on are different between upstream-side and downstream-side turbine stages in the cooling-requiring range.

The diaphragm-side cooling paths 51A to 51D and so on are formed through the internal diaphragms 18 in the axial direction of the rotor 14, and the cooling medium 27, such as cooling steam, flows through the diaphragm-side cooling paths 51A to 51D and so on, as in the cases of the diaphragm-side cooling paths 21 and others according to the first to third embodiments described hereinbefore. Each of the diaphragm-side cooling paths 51A to 51D and so on is actually formed of a plurality of diaphragm-side cooling paths formed through the internal diaphragms 18 at predetermined intervals in the circumferential direction of the rotor 14.

The diaphragm-side cooling path 51A in the internal diaphragm 18 in each upstream-side turbine stage (first and second turbine stages, for example) is formed so as to linearly extend in parallel to the axis of the rotor 14, as in the case of the diaphragm-side cooling path 21 according to the first embodiment. The diaphragm-side cooling paths 51B to 51D and so on in the internal diaphragms 18 in downstream-side turbine stages (third to sixth turbine stages, for example) are formed so as to be inclined to the axis of the rotor 14 from the side at which the vanes 12 are present toward the rotor 14 and linearly extend. As a result, outlets 53 of the diaphragm-side cooling paths 51B to 51D and so on are closer to the rotor 14 than inlets 52 thereof in the radial direction of the internal diaphragms 18. That is, in the present embodiment, the inlets 52 and the outlets 53 of the diaphragm-side cooling paths 51A in the upstream-side turbine stages are formed in the uniform radial position, whereas the outlets 53 of the diaphragm-side cooling paths 51B to 51D and so on in the downstream-side turbine stages are formed in positions radially inside the inlets 52 thereof.

In the cooling-requiring turbine stage range, the cooling medium 27 having flowed out of the rotor-side cooling paths 22 in the rotor disc 15 in an adjacent turbine stage diverts into one of the diaphragm-side cooling paths 51A to 51D and so on in the turbine stage and the labyrinth flow path 24. The cooling medium 27 having flowed out of the one of the diaphragm-side cooling paths 51A to 51D and so on and the cooling medium 27 having flowed out of the labyrinth flow path 24 merge, and the merged cooling medium 27 flows into the rotor-side cooling paths 22 in the rotor disc 15 in the same turbine stage. According to the configuration or arrangement described above, the cooling medium 27 is prevented or substantially prevented from flowing into the steam path 19, and the rotor 14, the rotor discs 15 and the internal diaphragms 18 can be hence cooled.

As shown in FIG. 6, since the cooling medium 27 (cooling steam, for example) absorbs more heat when it travels downstream through the turbine stages, the temperature of the cooling medium 27 (cooling medium temperature Tc) gradually becomes higher, whereas since the primary steam 11 dissipates more heat when it travels downstream through the turbine stages, the temperature of the primary steam 11 (primary steam temperature Tg) becomes gradually lower. On the other hand, the temperature of a rotor disc 15, in particular, a target temperature Tm of the blade studded portions 15A of a rotor disc 15, is set at a lower value in a more downstream-side turbine stage. The reason for this matter resides in that the height of the blades 13 becomes greater in a more downstream-side turbine stage and the centrifugal force acting thereon increases or the force acting on the blade studded portions 15A of the rotor disc 15 increases accordingly, and in this case, necessary strength thereof can be ensured only by lowering the target temperature Tm.

Further, the temperature of the blade studded portions 15A of a rotor disc 15 is nearly equal to that of the primary steam 11 unless the portions 15A are cooled by the cooling medium 27. In order to lower the temperature of the blade studded portions 15A of a rotor disc 15 at least to the target temperature Tm, it is necessary to satisfy the following Expression (1):

$$X1\times(Tg-Tm)\leq X2\times(Tm-Tc) \quad (1)$$

In Expression (1), each of the coefficients X1 and X2 is a function of the following parameters: the length of a cooling path formed of one of the diaphragm-side cooling paths 51A to 51D and so on and the rotor-side cooling path 22 in the same turbine stage, the flow rate of the cooling medium 27, and other factors. That is, Expression (1) indicates that the amount of heat dissipated from a rotor disc 15 through the cooling medium 27 (cooling steam, for example) needs to be equal to or higher than the amount of heat transferred from the primary steam 11 to the rotor disc 15.

In a cooling-requiring turbine stage range, since the temperature Tc of the cooling medium 27 is much lower than the target temperature Tm of the blade studded portions 15A of a rotor disc 15 in an upstream-side turbine stage (the turbine stage A and a turbine stage close thereto in FIG. 6, for example), the temperature difference (Tm−Tc) becomes large, and hence, the cooling capacity of the steam turbine cooling structure 50 using the cooling medium 27 has extra capacity. The right-hand side value of Expression (1) is therefore greater than the left-hand side value of Expression (1), and Expression (1) is satisfied. In this case, in an upstream-side turbine stage within the cooling-requiring turbine stage range, the rotor 14, the rotor disc 15, and the internal diaphragm 18, particularly the blade studded portions 15A of the rotor disc 15, are suitably cooled even if the diaphragm-side cooling path 51A is formed so as to extend linearly in parallel to the axis of the rotor 14 as shown in FIG. 5.

In contrast, in a downstream-side turbine stage within the cooling-requiring turbine stage range (the turbine stage C and a turbine stage close thereto shown in FIG. 6, for example), since the temperature difference (Tm−Tc) between the target temperature Tm of the blade studded portions 15A of the rotor disc 15 and the temperature Tc of the cooling medium 27 decreases, the coefficient X2 needs to be greater in order to achieve a greater value of the right-hand side of Expression (1). To this end, for example, it is conceivable to increase the length of the cooling path formed of one of the diaphragm-side cooling paths 51B to 51D and so on and the rotor-side cooling path 22.

To achieve the above object, in the downstream-side turbine stages within the cooling-requiring turbine stage range, the diaphragm-side cooling paths 51B to 51D and so on are formed to be inclined to the axis of the rotor 14 and the outlets 53 are formed so as to be positioned closer to the rotor 14 than the inlets 52, as shown in FIG. 5. According to the configuration described above, it becomes possible to increase the length from the outlet 53 of any one of the diaphragm-side cooling paths 51B to 51D and so on to the inlet of the rotor-side cooling path 22 in the rotor disc 15 in the same turbine stage. As a result, the length of the cooling path formed of any one of the diaphragm-side cooling paths 51B to 51D and so on and the rotor-side cooling path 22 is increased, and the cooling medium 27 flows out of any one of the diaphragm-side cooling paths 51B to 51D and so on and impinges on the side surface of the rotor disc 15 in the same turbine stage, and the rotor disc 15 (including the blade studded portions 15A) is thereby cooled through the side surface. The cooling capacity of the steam turbine cooling structure 50 is thus increased.

A downstream turbine stage within a cooling-requiring turbine stage range used herein refers to a turbine stage downstream of a turbine stage (turbine stage B shown in FIG. 6, for example) at which the temperature difference (Tm−Tc) between the target temperature Tm of the blade studded portions 15A of the rotor disc 15 and the temperature Tc of the cooling medium 27 is at least equal to the temperature difference (Tg−Tm) between the target temperature Tm of the blade studded portions 15A of the rotor disc 15 and the temperature Tg of the primary steam 11.

A turbine stage, at which the temperature difference (Tm−Tc) is equal to the temperature difference (Tg−Tm), may also be configured as a downstream-side turbine stage at which any of the diaphragm-side cooling paths 51B to 51D and so on is formed to be inclined to the axis of the rotor 14. Such downstream-side turbine stages are, for example, the third to sixth turbine stages as described above, and upstream-side turbine stages within the cooling-requiring turbine stage range are those other than the downstream-side turbine stages described above, for example, the first and second turbine stages.

Further, the diaphragm-side cooling paths 51B to 51D and so on in the downstream-side turbine stages within the cooling-requiring turbine stage range in the present embodiment are formed so that the inclination angles thereof to the axis of the rotor 14 are designed to be greater in further downstream-side turbine stages, and that the outlets 53 thereof are positioned radially closer to the rotor 14 (further inward in the radial direction) in further downstream-side turbine stages, as shown in FIG. 5. The reason for this matter is to handle the situation in which the temperature Tc of the cooling medium 27 becomes gradually higher in a further downstream-side turbine stage and the cooling capacity of the cooling medium 27 becomes gradually lower accordingly. In order to lower the temperature of the blade studded portions 15A of a rotor disc 15 at least to the target temperature Tm thereof in consideration of the fact described above, the length of the cooling path formed of any one of the diaphragm-side cooling paths 51B to 51D and so on and the rotor-side cooling path 22 needs to be gradually longer in a further downstream-side turbine.

Therefore, the thus configured present embodiment provides not only advantageous effects similar to the advantageous effects (1) and (2) provided in the first embodiment described above but also the following advantageous effects (4) to (6).

(4) In the downstream-side turbine stages within a cooling-requiring turbine stage range at which the cooling is required, since the diaphragm-side cooling paths 51B to 51D and so on formed in the internal diaphragms 18 are formed so as to position the outlets 53 thereof to be closer to the rotor 14 than the inlets 52 thereof, the length of the cooling path formed of each of the diaphragm-side cooling paths 51B to 51D and so on and the rotor-side cooling path 22 provided in the rotor disc 15 in the same turbine stage can be increased.

Furthermore, the cooling medium 27 having flowed out of the outlet 53 of each of the diaphragm-side cooling paths 51B to 51D and so on impinges on the side surface of the rotor disc 15 in the same turbine stage, and therefore, the rotor disc 15 including the blade studded portions 15A can be cooled through the side surface. The turbine components in the downstream-side turbine stages within the cooling-requiring turbine stage range, particularly the rotor discs 15 including the blade studded portions 15A, can be suitably cooled even if the temperature of the cooling medium 27 flowing through the diaphragm-side cooling paths 51B to 51D and so on in the downstream-side turbine stages increases.

(5) The diaphragm-side cooling path 51A in an upstream-side turbine stage within the cooling-requiring turbine stage range is formed in parallel to the axis of the rotor 14 and linearly passes through the internal diaphragm 18. In the upstream-side turbine stage, since the temperature Tc of the cooling medium 27 is sufficiently low, the cooling medium 27 can suitably cool the rotor 14, the internal diaphragm 18, and the rotor disc 15 including the blade studded portions 15A. Furthermore, the diaphragm-side cooling path 51A, in a state in parallel to the axis of the rotor 14, can be readily machined through the internal diaphragm 18, resulting in the reduction in machining cost.

(6) The diaphragm-side cooling paths 51B to 51D and so on in the downstream-side turbine stages within the cooling-requiring turbine stage range are formed so that the outlets 53 thereof are positioned gradually closer to the rotor 14 in further downstream-side turbine stages. Thus, the temperature Tc of the cooling medium 27 gradually becomes higher in a further downstream-side turbine, and the cooling capacity of the cooling medium decreases, and accordingly, in the configuration described above, the length of the cooling path formed of any one of the diaphragm-side cooling paths 51B to 51D and so on and the rotor-side cooling path 22 can be made gradually longer in a further downstream-side turbine. As a result, the temperature of the blade studded portions 15A of the rotor disc 15 can be efficiently cooled at least to the target temperature Tm thereof.

Figure 7:
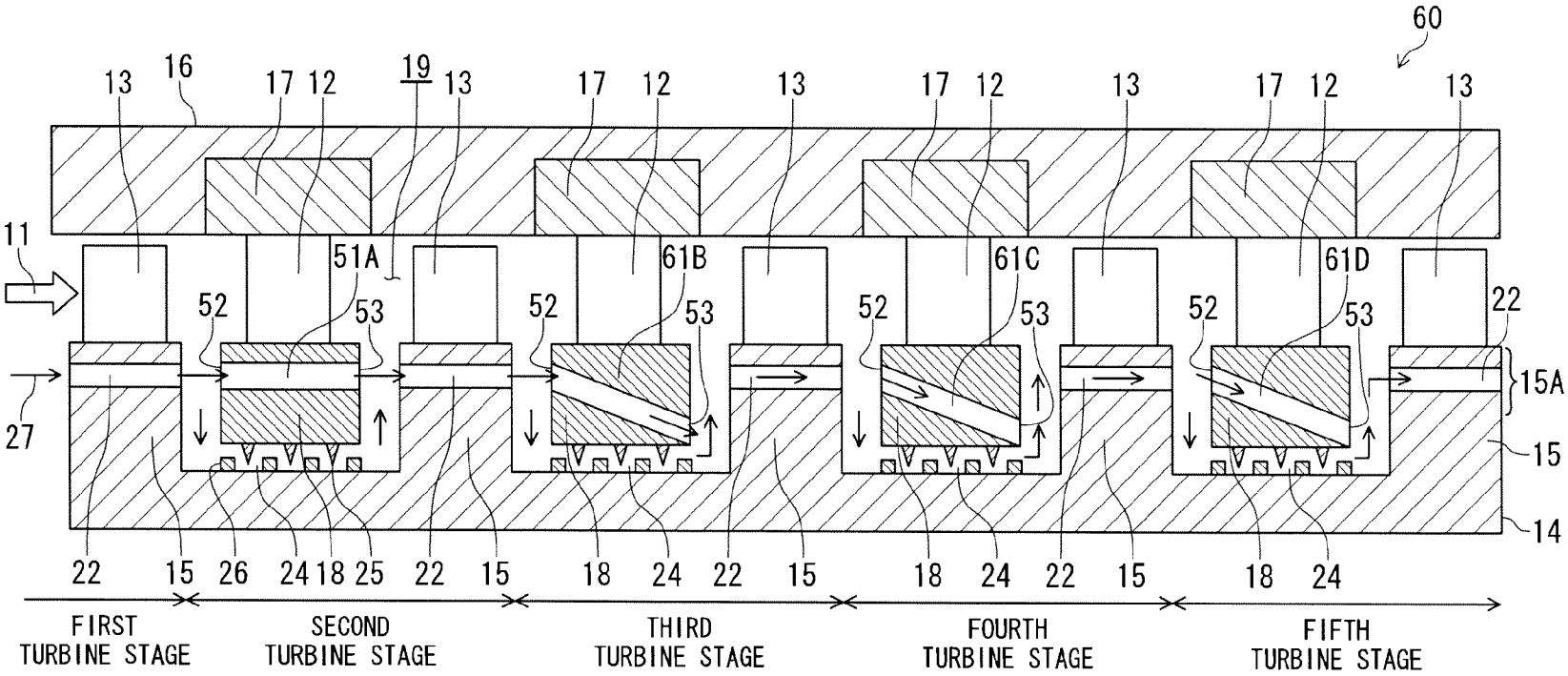
FIG. 7 is a partial cross-sectional view showing a part of a steam turbine according to a fifth embodiment of the present invention.

[E] Fifth Embodiment (FIG. 7)

FIG. 7 is a partial cross-sectional view showing a part of a steam turbine according to a fifth embodiment of the present invention. In the fifth embodiment, like reference numerals are added to portions or members corresponding or similar to those in the first embodiment (FIG. 1) and the fourth embodiment (FIG. 5), and descriptions of these portions will be simplified or omitted herein.

A steam turbine cooling structure 60 according to the present embodiment differs from the steam turbine cooling structure 50 according to the fourth embodiment in terms of the inclination angles and the positions of the outlets 53 of diaphragm-side cooling paths 61B to 61D and so on formed in the internal diaphragms 18 in the downstream-side turbine stages within a cooling-requiring turbine stage range.

That is, the diaphragm-side cooling paths 61B to 61D and so on in the downstream-side turbine stages within the cooling-requiring turbine stage range are designed to have the same inclination angle with respect to the axis of the rotor 14 that is necessary in the most downstream-side turbine stage and the uniform radial position of the outlet 53 that is necessary in the most downstream-side turbine stage. Each of the diaphragm-side cooling paths 61B to 61D and so on is actually formed of a plurality of diaphragm-side cooling paths arranged at predetermined intervals in the circumferential direction of the rotor 14 and passing through the internal diaphragm 18 substantially in the axial direction of the rotor 14.

The inclination angle necessary in the most downstream-side turbine stage and the outlet position necessary in the most downstream-side turbine stage are set to provide a cooling path having a length necessary to lower the temperature of the blade studded portions 15A of the rotor disc 15 in the most downstream-side turbine stage at least to the target temperature Tm thereof in consideration of the temperature Tc of the cooling medium 27 flowing through the most downstream-side turbine stage within the cooling-requiring turbine stage range.

Therefore, the thus configured present embodiment provides not only advantageous effects similar to the advantageous effects (1) and (2) provided in the first embodiment described above and advantageous effects similar to the advantageous effects (4) and (5) provided in the fourth embodiment described above but also the following advantageous effect (7).

(7) The positions of the outlets 53 of the diaphragm-side cooling paths 61B to 61D and so on in the downstream-side turbine stages within the cooling-requiring turbine stage range are designed to be the same outlet position necessary in the most downstream-side turbine stage. The diaphragm-side cooling paths 61B to 61D and so on can therefore be readily machined, and hence, the machining cost can be reduced as compared with a case where the positions of the outlets 53 of the diaphragm-side cooling paths are positioned closer to the rotor 14 in the further downstream-side turbine stages.

Figure 8:
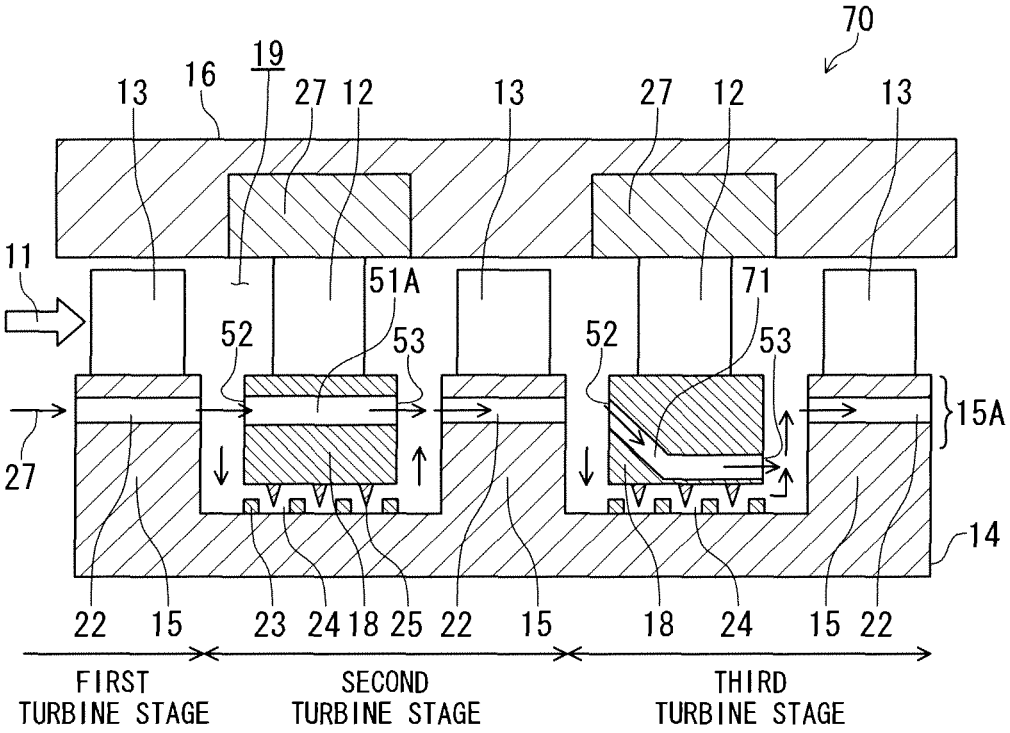
FIG. 8 is a partial cross-sectional view showing a part of a steam turbine according to a sixth embodiment of the present invention.

[F] Sixth Embodiment (FIG. 8)

FIG. 8 is a partial cross-sectional view showing a part of a steam turbine according to a sixth embodiment of the present invention. In the sixth embodiment, reference numerals are added to portions or members corresponding or similar to those in the first embodiment (FIG. 1) and the fourth embodiment (FIG. 5), and descriptions of these portions will be simplified or omitted herein.

A steam turbine cooling structure 70 according to the present embodiment differs from the steam turbine cooling structure 50 according to the fourth embodiment in terms of the shape of a diaphragm-side cooling path 71 formed in the internal diaphragm 18 in a downstream-side turbine stage within a cooling-requiring turbine stage range.

That is, the diaphragm-side cooling path 71 in the downstream-side turbine stage is formed through the internal diaphragm 18 so as to be inclined to the axis of the rotor 14 from the side at which the vanes 12 are present toward the rotor 14, extends linearly to a point somewhere in the middle of the internal diaphragm 18, and further extends in parallel to the axis of the rotor 14 in the axial direction of the rotor 14.

The diaphragm-side cooling path 71 is actually formed of a plurality of diaphragm-side cooling paths passing through the internal diaphragm 18 and arranged at predetermined intervals in the circumferential direction of the rotor 14. The inlet 52 of the diaphragm-side cooling path 71 is provided at an end of the inclined portion of the diaphragm-side cooling path 71, and the outlet 53 of the diaphragm-side cooling path 71 is provided at an end of the parallel portion of the diaphragm-side cooling path 71. That is, in the present embodiment, the diaphragm-side cooling path 71 is characterized in that at least a part thereof has a portion parallel to the axis of the rotor 14.

The outlet 53 of the diaphragm-side cooling path 71 may alternatively be positioned closer to the rotor 14 in a further downstream-side turbine stage as in the fourth embodiment, or may alternatively have the same position necessary in the most downstream-side turbine stage as in the fifth embodiment. FIG. 8 shows an example of the latter case (same position setting).

Therefore, the thus configured present embodiment provides the following advantageous effect (8) in addition to the advantageous effects similar to the advantageous effects (1) and (2) provided in the first embodiment described above, the advantageous effects similar to the advantageous effects (4) to (6) provided in the fourth embodiment described above, and the advantageous effects similar to the advantageous effect (7) provided in the fifth embodiment described above.

(8) The diaphragm-side cooling path 71 formed in the internal diaphragm 18 in a downstream-side turbine stage within a cooling-requiring turbine stage range is formed so as to be inclined to the axis of the rotor 14, extends to a point somewhere in the middle of the internal diaphragm 18, and further extends in parallel to the axis of the rotor 14. The inlet 52 is provided at an end of the inclined portion and the outlet 53 is provided at an end of the parallel portion. According to the configuration described above, since the cooling medium 27 flowing through the parallel portion of the diaphragm-side cooling path 71 and flowing out of the outlet 53 thereof impinges on the side surface of the rotor disc 15 in the same turbine stage at a right angle, the cooling medium 27 can efficiently cool the rotor disc 15 (including the blade studded portions 15A).

It is to be noted that the present invention is not limited to the embodiments described above and many other changes and modifications may be made without departing from the scope of the appended claims.

The invention claimed is:

1. A steam turbine comprising:

a rotor;

a rotor disc integrated with the rotor;

a plurality of blades studded in the rotor disc in an arrangement along a circumferential direction of the rotor;

a casing that covers the rotor;

a plurality of vanes attached to the casing along the circumferential direction of the rotor in positions adjacent to the blades and on an upstream side in an axial direction of the rotor; and an internal diaphragm disposed on rotor-side surfaces of the vanes in the axial direction of the rotor in such a way that the internal diaphragm faces the rotor disc, in which the vanes and the blades adjacent to each other in the axial direction of the rotor form a turbine stage, wherein in at least one of the turbine stages, a rotor-side cooling path is formed through the rotor disc in the axial direction of the rotor and a diaphragm-side cooling path is formed through the internal diaphragm in the axial direction of the rotor, and a cooling medium flowing through the rotor-side cooling path diverts into the diaphragm-side cooling path and a labyrinth flow path provided between the internal diaphragm and the rotor, and wherein a plurality of turbine stages, each of which has the diaphragm-side cooling path which passes through the internal diaphragm in the axial direction of the rotor and through which the cooling medium flows, are formed, and among the plurality of turbine stages, each of which has the diaphragm-side cooling paths formed therein, the diaphragm-side cooling path is formed in parallel to the axis of the rotor in an upstream-side turbine stage, an outlet of the diaphragm-side cooling path which is linearly formed is positioned radially closer to the rotor than an inlet of the diaphragm-side cooling path in a downstream-side turbine stage, and an inclination angle of the diaphragm-side cooling path in a next downstream-side turbine stage to the axis of the rotor is greater than the inclination angle of the diaphragm-side cooling path in the downstream-side turbine stage to the axis of the rotor.

2. The steam turbine according to claim 1, wherein proportions of the cooling medium that diverts into the diaphragm-side cooling path and the labyrinth flow path are determined based on pressure loss in the diaphragm-side cooling path and pressure loss in the labyrinth flow path.

3. The steam turbine according to claim 1, wherein a shape of the diaphragm-side cooling path is determined in accordance with a portion that requires cooling and pressure loss in the labyrinth flow path.

4. The steam turbine according to claim 1, further comprising a movable fin disposed in the internal diaphragm, wherein the movable fin is moved by the cooling medium in the axial direction of the rotor to narrow a gap between the internal diaphragm and an adjacent rotor disc.

5. The steam turbine according to claim 1, wherein the downstream-side turbine stage is a turbine stage arranged downstream of a turbine stage where a temperature difference (Tm−Tc) is at least equal to a temperature difference (Tg−Tm), in which Tc represents a temperature of the cooling medium, Tg represents a temperature of primary steam, and Tm represents a target temperature of the rotor disc.

6. The steam turbine according to claim 1, wherein in the downstream-side turbine stages, an outlet of the diaphragm-side cooling path is positioned radially closer to the rotor than an outlet of a diaphragm-side cooling path in a preceding downstream-side turbine stage.

7. The steam turbine according to claim 1, wherein the outlets of the diaphragm-side cooling paths in the downstream-side turbine stages are located in a uniform radial position necessary in a most downstream-side turbine stage.

8. The steam turbine according to claim 1, wherein the diaphragm-side cooling path in each of the downstream turbine stages is formed to be inclined to the axis of the rotor.

9. The steam turbine according to claim 1, wherein at least part of the diaphragm-side cooling path in each of the downstream-side turbine stages has a portion parallel to the axis of the rotor.

* * * * *